US009658564B1

(12) United States Patent
Yamasaki

(10) Patent No.: US 9,658,564 B1
(45) Date of Patent: May 23, 2017

(54) CONTROL DEVICE, CONTROL METHOD, IMAGE FORMING APPARATUS, AND NON-TRANSITORY COMPUTER READABLE MEDIUM

(71) Applicant: FUJI XEROX CO., LTD., Tokyo (JP)

(72) Inventor: Naoya Yamasaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/149,597

(22) Filed: May 9, 2016

(30) Foreign Application Priority Data

Dec. 22, 2015 (JP) ..... 2015-249318

(51) Int. Cl.
*G03G 15/00* (2006.01)
*G03G 15/043* (2006.01)

(52) U.S. Cl.
CPC ..... *G03G 15/043* (2013.01); *G03G 15/5016* (2013.01); *G03G 15/5062* (2013.01)

(58) Field of Classification Search
CPC ..... G03G 15/043; G03G 15/5016; G03G 15/5062
USPC ..... 399/49, 51, 72, 81
See application file for complete search history.

(56) References Cited

U.S. PATENT DOCUMENTS 8,938,174 B2 * 1/2015 Hirata et al. ..... G03G 15/5062 399/49
2011/0292461 A1 12/2011 Kubo

FOREIGN PATENT DOCUMENTS

JP 2012-014149 A 1/2012

* cited by examiner

*Primary Examiner* — William J Royer
(74) *Attorney, Agent, or Firm* — Oliff PLC

(57) ABSTRACT

A control device includes a first reception section, a second reception section, a third reception section, and a first command section. The first reception section receives first information from a user when an image forming unit forms a first image onto a medium based on image data and outputs the first image to the user. The first information indicates a position of noise occurring with predetermined periodicity in a transport direction of the medium. The second reception section receives, from the user, second information corresponding to a density of the noise. The third reception section receives, from the user, third information indicating a width of the noise in the transport direction. The first command section commands the image forming unit to form a second image obtained by correcting the first image onto the medium based on the first information, the second information, and the third information.

10 Claims, 8 Drawing Sheets

FIG. 3

121

| SETTING ITEM | SET VALUE |
|---|---|
| DISTANCE X1 FROM REFERENCE POINT | 3 |
| DENSITY LEVEL X2 | 4 |
| WIDTH X3 | 4 |

FIG. 4

122

| WAVEFORM ID | WAVEFORM DATA |
|---|---|
| w1 | ••• |
| w2 | ••• |
| w3 | ••• |
| ⋮ | ⋮ |

CONTROL DEVICE, CONTROL METHOD, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2015-249318 filed Dec. 22, 2015.

BACKGROUND

Technical Field

The present invention relates to control devices, control methods, image forming apparatuses, and non-transitory computer readable media.

SUMMARY

According to an aspect of the invention, there is provided a control device including a first reception section, a second reception section, a third reception section, and a first command section. The first reception section receives first information from a user when an image forming unit forms a first image onto a medium based on image data and outputs the first image to the user. The first information indicates a position of noise occurring with predetermined periodicity in a transport direction of the medium. The second reception section receives, from the user, second information corresponding to a density of the noise. The third reception section receives, from the user, third information indicating a width of the noise in the transport direction. The first command section commands the image forming unit to form a second image obtained by correcting the first image onto the medium based on the first information, the second information, and the third information.

BRIEF DESCRIPTION OF THE DRAWINGS

An exemplary embodiment of the present invention will be described in detail based on the following figures, wherein:

FIG. 3 illustrates an example of a correction-value table;

FIG. 4 illustrates an example of a waveform table;

DETAILED DESCRIPTION

1. Exemplary Embodiment

1.1. Overall Configuration of Image Forming Apparatus

Figure 1:
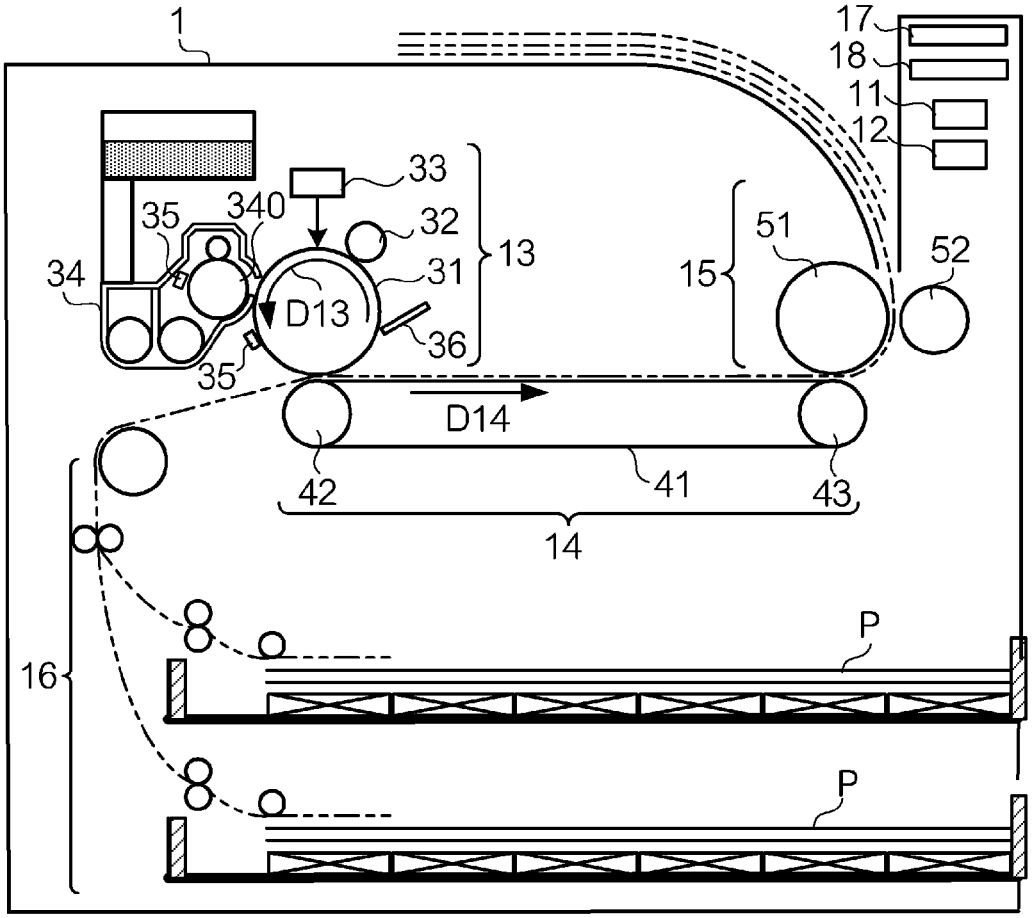
FIG. 1 illustrates the overall configuration of an image forming apparatus according to an exemplary embodiment.
Figure 2:
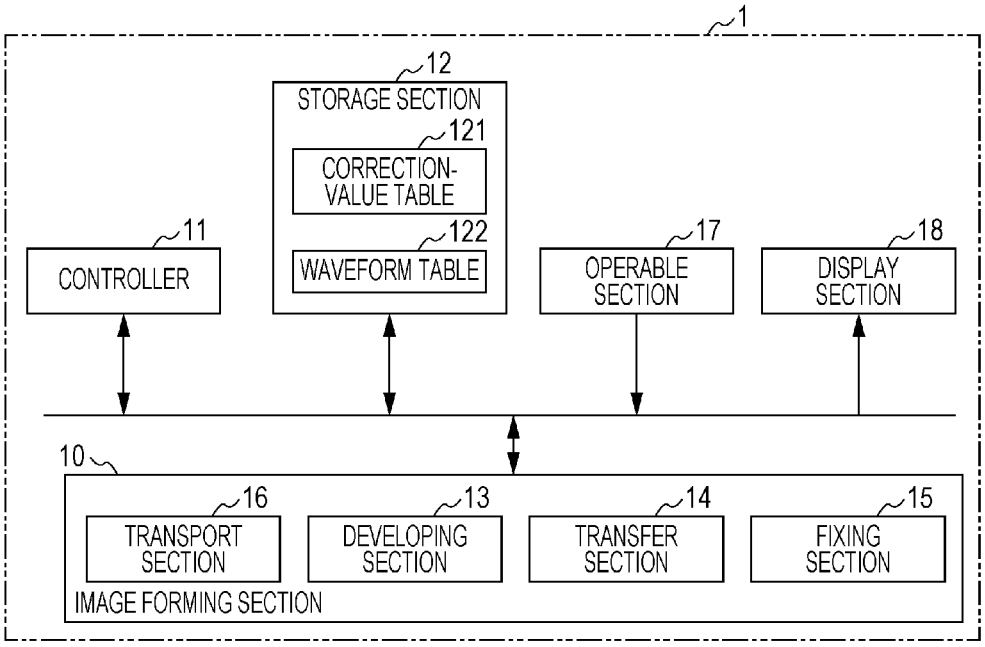
FIG. 2 is a block diagram illustrating the configuration of the image forming apparatus.

FIG. 1 illustrates the overall configuration of an image forming apparatus 1 according to an exemplary embodiment. FIG. 2 is a block diagram illustrating the configuration of the image forming apparatus 1. As shown in FIGS. 1 and 2, the image forming apparatus 1 has a controller 11, a storage section 12, an operable section 17, a display section 18, and an image forming section 10. The image forming section 10 has a developing section 13, a transfer section 14, a fixing section 15, and a transport section 16.

The controller 11 has a central processing unit (CPU), a read-only memory (ROM), and a random access memory (RAM). The CPU serves as a control device that reads and executes a computer program (which will simply be referred to as "program" hereinafter) stored in the ROM or the storage section 12 so as to control each section of the image forming apparatus 1.

The operable section 17 includes operators, such as operable buttons and a touchscreen, for inputting various kinds of commands. The operable section 17 receives user operation and supplies a signal according to the operation contents to the controller 11.

The display section 18 has a liquid crystal display and displays, for example, various kinds of information commanded by the controller 11. The touchscreen of the operable section 17 may be disposed over the liquid crystal display of the display section 18. In this case, the touchscreen is formed of a transparent material so as to allow the user to view an image displayed on the liquid crystal display of the display section 18.

The transport section 16 has a container and a transport roller. The container accommodates therein sheets P as media cut to a predetermined size. The sheets P accommodated in the container are fetched one-by-one by the transport roller in accordance with a command from the controller 11 and are transported to the transfer section 14 via a sheet transport path. The media are not limited to paper sheets and may be, for example, resinous sheets. In other words, the media may be of any type onto which images are recordable onto the surfaces thereof.

The developing section 13 is a developing device that includes an image bearing member 31, a charging unit 32, an exposure unit 33, a developing unit 34, a rotating meter 35, and a drum cleaner 36. The image bearing member 31 has a charge generation layer and a charge transport layer and is rotated in a direction of an arrow D13 by a driver (not shown). The charging unit 32 electrostatically charges the surface of the image bearing member 31. The exposure unit 33 exposes the electrostatically-charged surface of the image bearing member 31 to light in accordance with input image data so as to form a latent image thereon.

The image data described above may be read by the controller 11 from the storage section 12 in accordance with a command received as a result of the user operating the operable section 17, or may be acquired by the controller 11 from an external device via a communication unit (not shown). The external device is, for example, a reading device that reads an original image or a storage device that stores therein image data indicating an image.

The developing unit 34 has a toner bottle as a container that accommodates therein a two-component developer containing a monochrome toner, such as a black toner, and a magnetic carrier, such as ferrite powder, and also has a toner cartridge that receives the developer supplied from this toner bottle and supplies the developer to the image bearing member 31. The toner cartridge has a stirrer that stirs the received developer, a cylindrical developing sleeve 340 that causes the developer to adhere to the surface thereof in accordance with a magnetic field and transports the developer to the image bearing member 31, a magnetic-field applying device that is disposed inside the developing sleeve 340 and applies a magnetic field to the developing sleeve. 340, and a cleaner that removes the developer remaining on the surface of the developing sleeve 340. The applied magnetic field causes the tips of a magnetic brush formed on the surface of the developing sleeve 340 to come into contact with the surface of the image bearing member 31 so that the toner adheres to an area of the surface of the image bearing member 31 exposed to the light from the exposure unit 33, whereby an image is formed (developed) on the image bearing member 31.

The rotating meter 35 measures the phase of the developing sleeve 340 by using a light emitting element, such as a light emitting diode (LED), to radiate light onto a marker, such as a reflecting mirror, bonded to a motion transmission member, such as a shaft or a gear, which rotates the developing sleeve 340, and by capturing the light reflected from this marker by using a light receiving element, such as a photodiode.

The drum cleaner 36 removes non-transferred toner remaining on the surface of the image bearing member 31 after an image transfer process and removes electric charge from the surface of the image bearing member 31. Specifically, the drum cleaner 36 removes unwanted toner and electric charge from the image bearing member 31 so as to prepare for a subsequent image forming process.

The transfer section 14 shown in FIG. 1 includes a belt 41, a transfer roller 42, and a belt transport roller 43 and transfers the image formed by the developing section 13 onto a sheet P of a predetermined paper type set in accordance with user operation.

The belt 41 is an endless belt member that is extended between the transfer roller 42 and the belt transport roller 43.

In accordance with a potential difference between the transfer roller 42 and the image bearing member 31 of the developing section 13, the transfer roller 42 transfers the image on the surface of the image bearing member 31 onto the sheet P transported from the transport section 16.

At least one of the transfer roller 42 and the belt transport roller 43 is rotated by a driver (not shown), thus causing the belt 41 to rotate. The sheet P having the image transferred thereon from the image bearing member 31 by the transfer roller 42 is transported in a direction of an arrow D14 by the rotating belt 41.

The fixing section 15 has a heating roller 51 and a pressing roller 52. The pressing roller 52 presses the sheet P transported by the belt 41 of the transfer section 14 onto the heating roller 51. The heating roller 51 heats the sheet P pressed by the pressing roller 52 so as to fix the image transferred on the sheet P. The sheet P having the image fixed thereon is ejected from an upper ejection port of the image forming apparatus 1 and is placed on a sheet tray.

The storage section 12 is a mass storage unit, such as a hard disk drive, and stores a program to be read by the CPU of the controller 11. Moreover, as shown in FIG. 2, the storage section 12 stores a correction-value table 121 and a waveform table 122.

FIG. 3 illustrates an example of the correction-value table 121. The correction-value table 121 has a setting-item field indicating setting items to be used for correction and also has a set-value field indicating parameters to be set for the respective setting items. The setting items include a distance X1 from a reference point, a density level X2, and a width X3. For each of set values corresponding to these items, a value input by the user as a result of operating the operable section 17 is set.

FIG. 4 illustrates an example of the waveform table 122. The waveform table 122 has a waveform ID, which is for identifying a waveform prepared in advance, and waveform data, which is data indicating that waveform, written therein in association with each other. For example, if a waveform is expressed with a polygonal shape, the waveform data has the apexes of the polygon listed therein. If a waveform is expressed with a curve, such as a Bezier curve, the waveform data has control points of that curve listed therein. With these pieces of waveform data, for example, waves that indicate positive portions of triangular waves, rectangular waves, saw-shaped waves, and sine waves are expressed. Furthermore, the waveform data may have written therein, for example, the relationship between the name of the waveform and the corresponding setting item in the correction-value table 121.

1.2. Functional Configuration of Controller

Figure 5:
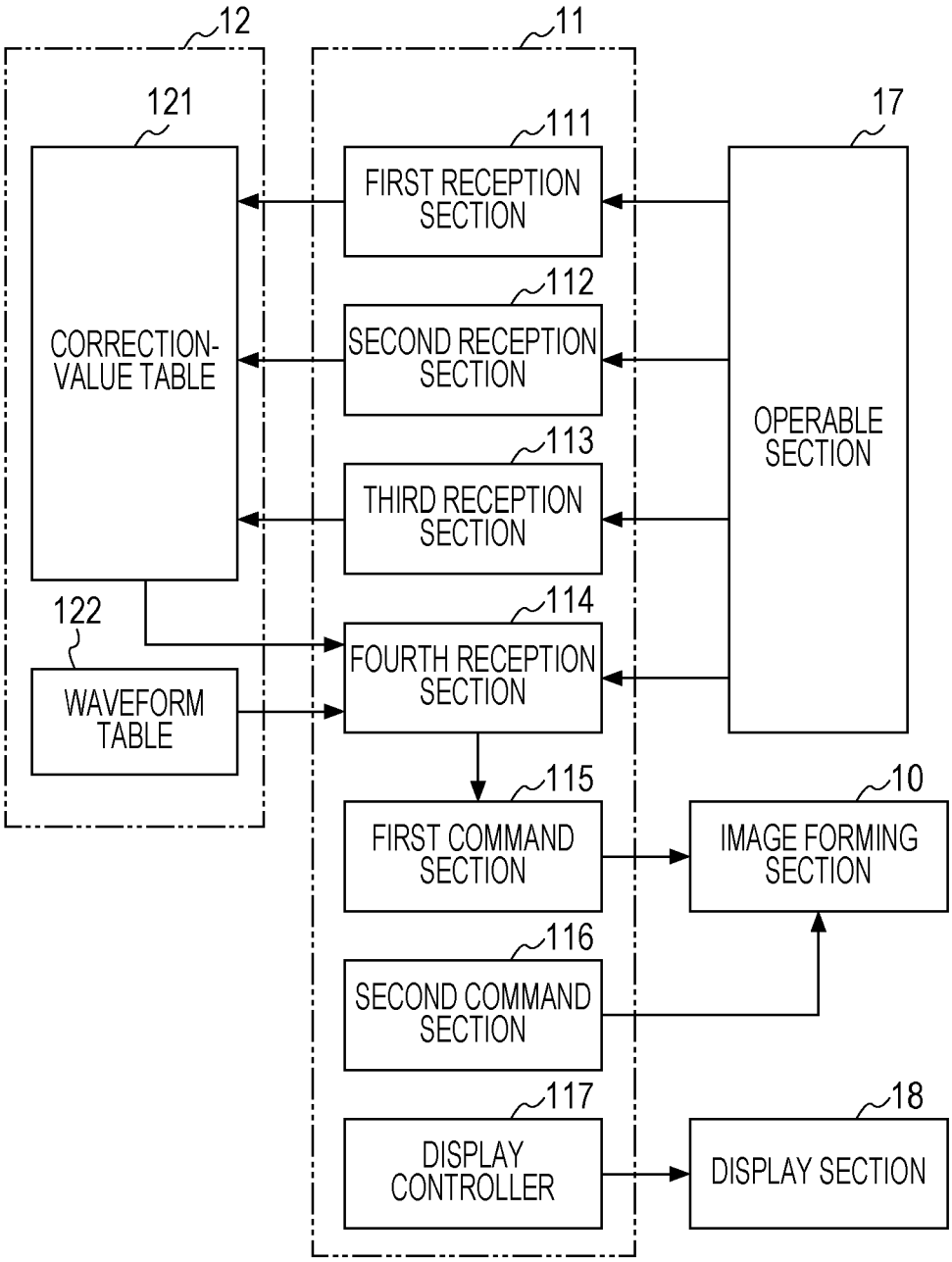
FIG. 5 illustrates a functional configuration of a controller that controls the image forming apparatus.

FIG. 5 illustrates a functional configuration of the controller 11 that controls the image forming apparatus 1. The controller 11 executes the aforementioned program so as to function as a first reception section 111, a second reception section 112, a third reception section 113, a fourth reception section 114, a first command section 115, a second command section 116, and a display controller 117.

The second command section 116 commands the image forming section 10 to form a predetermined test image onto a medium. A test image is, for example, a halftone image having uniform density data. The image forming section 10 receives this command and forms a halftone image onto the medium.

The display controller 117 causes the display section 18 to display, for example, an operable screen used for inputting correction settings and an operable screen used for inputting waveform selection.

When the operable screen for inputting correction settings is displayed on the display section 18, if the user operates the operable section 17 to set correction values, the first reception section 111, the second reception section 112, and the third reception section 113 receive the contents of this operation and write the acquired correction values in the correction-value table 121.

Specifically, when the image forming section 10 forms a first image onto a sheet P (medium) based on image data and outputs the sheet P having the first image formed thereon to the user, the first reception section 111 receives first information indicating the distance X1 from the reference point, which is the position of noise occurring with predetermined periodicity in the transport direction of the sheet P, from the user via the operable section 17 and writes the first information in the correction-value table 121.

The second reception section 112 receives second information indicating the density level X2, which is a representative density value of the aforementioned noise, from the user via the operable section 17 and writes the second information in the correction-value table 121. The density level X2 may be a gradation value of a density difference or may indicate a group to which the gradation value belongs if the density difference is divided into multiple groups in advance.

The third reception section 113 receives third information indicating the width X3, which is the width of the aforementioned noise in the transport direction of the sheet P, from the user via the operable section 17 and writes the third information in the correction-value table 121.

When the operable screen for inputting waveform selection is displayed on the display section 18, if the user operates the operable section 17 to select a waveform, the fourth reception section 114 receives the contents of this operation and specifies the waveform selected from among the waveforms written in the waveform table 122.

When the fourth reception section 114 specifies the selected waveform, the first command section 115 reads the received first information, second information, and third information from the correction-value table 121, reads information related to the selected waveform from the waveform table 122, and commands the image forming section 10 to form a corrected image onto the sheet P based on the position indicated by the first information, the representative value indicated by the second information, and the width indicated by the third information.

In this case, the first command section 115 commands the image forming section 10 to form the image corrected in accordance with the waveform (one shape) indicated by the command received by the fourth reception section 114 onto the sheet P. The image forming section 10 receiving this command sets the waveform selected by the user at the distance X1 from the reference point and adjusts the quantity of light traveling toward the position on the surface of the image bearing member 31 corresponding to that position in accordance with the density level X2 and the width X3. Consequently, the noise may be reduced.

1.3. Operation of Image Forming Apparatus

Figure 6:
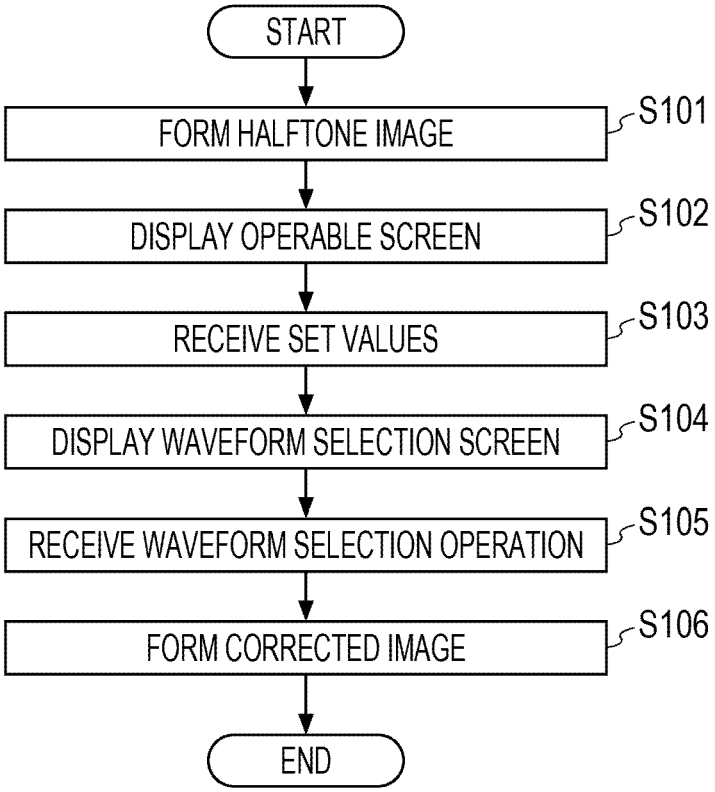
FIG. 6 is a flowchart illustrating the flow of the operation of the image forming apparatus.

FIG. 6 is a flowchart illustrating the flow of the operation of the image forming apparatus 1. In step S101, the controller 11 commands the image forming section 10 to form a predetermined halftone image. The image forming section 10 receives this command and forms a halftone image onto a sheet P. When the controller 11 receives user operation indicating a command for forming a test image via the operable section 17, the controller 11 may command that this halftone image be formed or may send this command at another timing. The image forming apparatus 1 may command that a test image be formed when, for example, the user performs operation for designating an output mode for setting, for example, the type of screen to be applied to image formation.

Figure 7A:
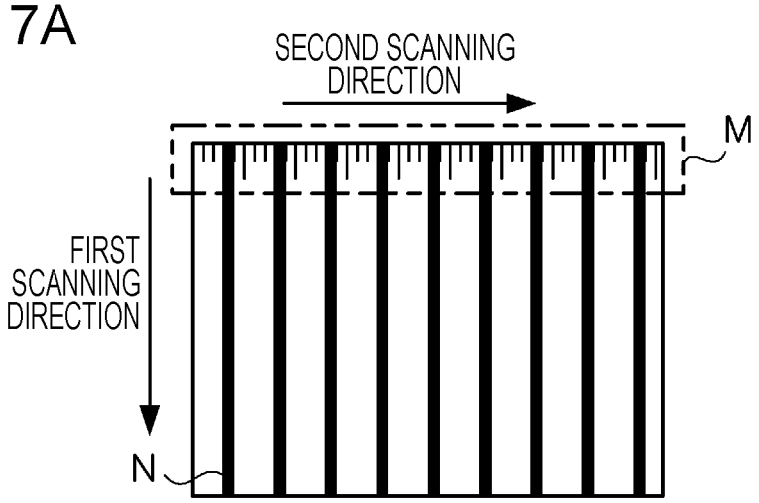
FIGS. 7A to 7C illustrate an example of a halftone image.
Figure 7B:
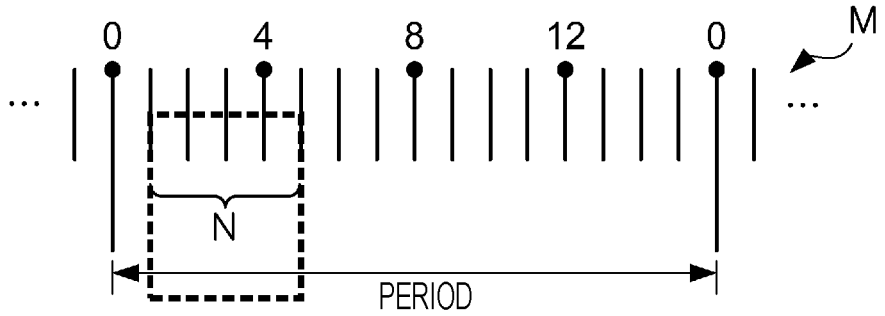
Figure 7C:
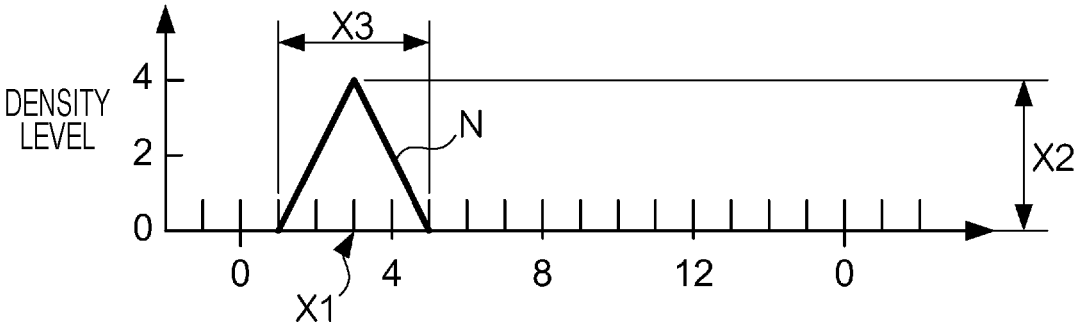

FIGS. 7A to 7C illustrate an example of the halftone image. Although this halftone image has uniform density as image data, since there is unevenness in the circumferential direction of the developing sleeve 340, the density may become non-uniform periodically in the transport direction of the sheet P when the halftone image is formed on the sheet P. The transport direction of the sheet P corresponds to the circumferential direction of the developing sleeve 340 and thus corresponds to a second scanning direction for scanning the image bearing member 31. As shown in FIG. 7A, when non-uniformity occurs, streaky noise occurs in the sub scanning direction with a period according to the perimeter of the developing sleeve 340 (to be precise, a length unit obtained by dividing the perimeter of the developing sleeve 340 by the peripheral speed ratio between the developing sleeve 340 and the image bearing member 31). The noise is a region where the density difference between input image data and a first image formed based on the image data is larger than or equal to a threshold value. If the image data indicates a halftone image with uniform density, the noise is visually recognized by the user as a region with density different from other regions (i.e., non-uniform density) when the image data is formed as a first image onto the sheet P.

When the image forming section 10 is to form a halftone image onto the sheet P, a positional-information image M serving as a scale for indicating positions in the transport direction is formed on the sheet P. FIG. 7B is an enlarged view of the positional-information image M. In the positional-information image M, the period according to the perimeter of the developing sleeve 340 is divided into multiple segments (16 segments in the example shown in FIG. 7B) by multiple markers, such that the positional-information image M is used for specifying the positions of noise occurring with this period.

A position on this scale is determined in conjunction with the phase measured by the rotating meter 35. Specifically, when the developing sleeve 340 is set at a reference position or orientation by the rotating meter 35, "0" is printed on the scale. In this case, this "0" indicates a reference position in the transport direction of the sheet P.

When the user confirms streaky noise N in an area indicated by a dashed line in FIG. 7B, the user refers to the scale in the positional-information image M so as to read the range of this noise N in the second scanning direction, that is, the width thereof and the density level at a position of a notable area indicating the most-deviated density from the original density of this noise N (i.e., an area indicating the most-deviated density from the density of other areas in the case of a uniform halftone image).

For example, as shown in a graph in FIG. 7C, in a case where the noise N causes the density level to increase from "0" to "4" at distances of "1" to "3" from the reference point and the density level to decrease from "4" to "0" at distances of "3" to "5" from the reference point, the user reads a peak position "3" of the noise N as the distance from the reference point and reads a length "4" from "1" to "5" as the width. Then, the user observes the density of the noise N at the peak position "3" of the noise N and determines that the density level indicating a density difference with respect to the original density at that position is "4". A test image may include, in addition to a halftone image, a reference image to be used by the user for determining the density level by visual comparison. In this reference image, for example, multiple numerical values respectively indicating' multiple density levels and images with these multiple density levels are rendered in association with each other.

After the halftone image is formed on the transported sheet P, the controller 11 displays an operable screen to be used for inputting correction set values to the image forming section 10 in step S102.

Figure 8:
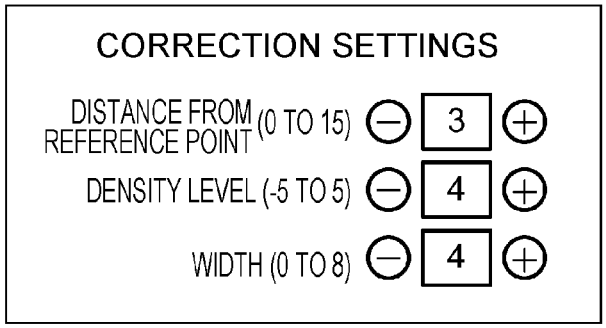
FIG. 8 illustrates an example of an operable screen for inputting correction set values.

FIG. 8 illustrates an example of the operable screen for inputting correction set values. This operable screen includes a title "correction settings" and has correction setting items listed below the title. To the right of each setting item, a rectangle serving as a set-value input field is displayed. A "+" button for increasing a set value is disposed to the right of each rectangle, and a "−" button for decreasing a set value is disposed to the left of each rectangle. When the user focuses on one of these input fields, the user directly inputs a set value thereto by operating, for example, a numerical keypad. Moreover, the user adjusts each set value by pressing the "+" button or the "−" button via the touchscreen.

When the operable screen for inputting correction set values is displayed on the display section 18, the controller 11 receives the set values input via this operable screen in step S103.

Subsequently, the controller 11 reads a candidate waveform ID and waveform data associated with this waveform ID from the waveform table 122 and causes the display section 18 to display the waveform indicated by the waveform data together with the corresponding waveform ID in step S104.

Figure 9:
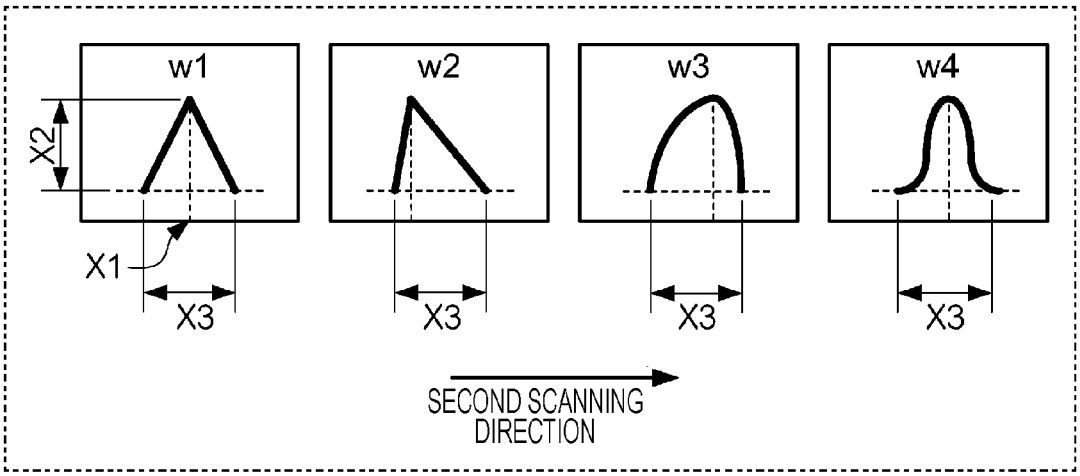
FIG. 9 illustrates an example of an operable screen used for waveform selection.

FIG. 9 illustrates an example of the operable screen used for waveform selection. This operable screen includes multiple buttons illustrating respective waveform IDs and schematic diagrams of the waveforms. For example, in a case where a waveform ID is "w1", the corresponding schematic diagram shows an equilateral-triangular waveform. The user performs operation by selecting one of these buttons suitable for a density change in the second scanning direction of the noise N occurring on the sheet P. In step S105, the controller 11 receives this operation (waveform selection operation).

When the controller 11 receives the waveform selection operation, the controller 11 commands the image forming section 10 to form an image corrected in accordance with the waveform indicated by the received command onto the sheet P in step S106.

The correction is performed by, for example, adjusting the intensity of laser light radiated from the exposure unit 33 of the developing section 13.

Figure 10A:
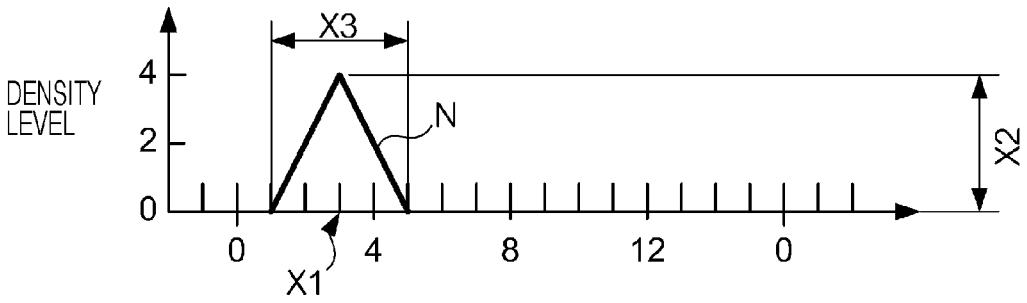
FIGS. 10A and 10B illustrate an example of correction.
Figure 10B:
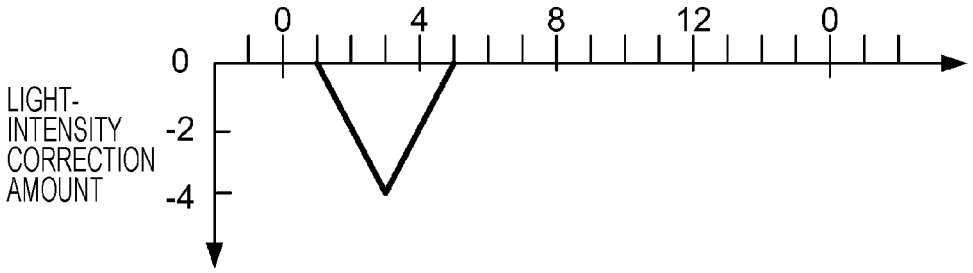

FIGS. 10A and 10B illustrate an example of the correction. In accordance with the distance X1 from the reference point, the density level X2, and the width X3 received by the controller 11, the noise N is ascertained as shown in FIG. 10A. In this case, the intensity of laser light radiated from the exposure unit 33 is corrected in accordance with a light-intensity correction amount shown in FIG. 10B. Specifically, the light-intensity correction amount changes from "0" to "−4" as the distance from the reference point changes from "1" to "3", and changes from "−4" to "0" as the distance from the reference point changes from "3" to "5". Thus, the light exposure in the area with the density level of "4" due to the noise N prior to the correction is reduced, so that the amount of adhesion of the developer decreases, whereby the region of the noise N may be reduced.

Although the light-intensity correction amount is adjusted in accordance with the distance from the reference point, the distance from the reference point is set by the controller 11 by referring to the phase measured by the rotating meter 35 when the image forming section 10 is to form a corrected image. Thus, even if the transport timing of the sheet P is out of synchronization with the rotational state or orientation of the developing sleeve 340, the position at which image writing begins is adjusted based on the measured phase of the developing sleeve 340. Specifically, a position at which noise occurs based on distortion in the circumference direction of the developing sleeve 340 is ascertained by the controller 11 by acquiring the phase of the developing sleeve 340.

For example, noise that is asymmetrical in the increasing-decreasing direction or noise occurring toward only one of positive and negative sides (one-sided noise) is not suitable for correction using a waveform that is symmetrical in the increasing-decreasing direction, such as a sine wave. This is because, if the position or size of a sine wave, which decreases to cancel out a noise portion, is set, new noise occurs in other areas.

Because the image forming apparatus 1 according to the exemplary embodiment of the present invention operates in the above-described manner to correct an image so as to reduce noise N specified in accordance with the distance X1 from the reference point, the density level X2, and the width X3, the image forming apparatus 1 may even remove, for example, noise that is asymmetrical in the increasing-decreasing direction.

2. Modifications

Although the exemplary embodiment has been described above, the contents of this exemplary embodiment may be modified as follows. Moreover, the following modifications may be combined.

2.1. First Modification

In the above-described exemplary embodiment, the controller 11 sets the distance from the reference point by referring to the phase measured by the rotating meter 35. Alternatively, the controller 11 may set the distance from the reference point without referring to the phase. For example, in a case where the transport timing by the transport section 16 is in synchronization with the rotation of the developing sleeve 340, the timing at which the sheet P is transported to and nipped at a transfer position, which is where an image is transferred from the image bearing member 31, is in synchronization with the timing at which the developing sleeve 340 is set to a reference orientation (angle). Therefore, the controller 11 does not have to refer to the phase to set the distance from the reference point.

2.2. Second Modification

In the above-described exemplary embodiment, the controller 11 of the image forming apparatus 1 commands the image forming section 10 to form a corrected image onto the sheet P so as to reduce the region of the noise N. Alternatively, the controller 11 may correct an image based on the distance X1 from the reference point, the density level X2, and the width X3 and make the image forming section 10 form the image onto the sheet P. For example, even if the region of the noise N itself is not reduced, the image may be corrected such that the areas where the noise N occurs are scattered to an extent that they are not visually noticeable to the user.

2.3. Third Modification

In the above-described exemplary embodiment, the correction is performed by adjusting the intensity of exposure light from the exposure unit 33. Alternatively, the correction may be performed by adjusting other components. For example, the image may be corrected by adjusting the difference of voltages to be applied to the developing sleeve 340 and the image bearing member 31, or the image may be corrected by rewriting the image data itself. In other words, the correction may be performed by changing, for example, the development condition or the image data so that the streaky noise N occurring in the transport direction of the sheet P becomes less noticeable.

2.4. Fourth Modification

In the above-described exemplary embodiment, the fourth reception section 114 receives a command for selecting a waveform from the waveform table 122. Alternatively, the user does not have to select a waveform. In this case, the correction may be performed by using, for example, a single predetermined waveform. Furthermore, in this case, the storage section 12 does not have to store the waveform table 122.

2.5. Fifth Modification

In the above-described exemplary embodiment, the image forming apparatus 1 forms a halftone image as a test image. Alternatively, the image forming apparatus 1 may form an image other than a halftone image. Furthermore, the image forming apparatus 1 does not have to form a test image onto the sheet P if the user is capable of inputting correction set values. For example, the correction may be performed by sequentially using set values input by the user, and the noise may be made less noticeable based on a trial-and-error method in which the user views the image formed on the sheet P and changes the set values. Moreover, the image forming apparatus 1 may print an image prepared by the user and allow the user to determine the correction set values.

2.6. Sixth Modification

In the above-described exemplary embodiment, the image forming apparatus 1 corrects an image so that noise occurring with a period according to the perimeter of the developing sleeve 340 is made less noticeable. Alternatively, the image forming apparatus 1 may correct an image so that noise occurring with a period according to a component other than the developing sleeve 340 is made less noticeable. For example, the image forming apparatus 1 may correct an image so that noise occurring with a period according to the perimeter of the image bearing member 31 is made less noticeable.

Furthermore, an image may be corrected so that noise of multiple lines occurring with multiple periods is made less noticeable. In this case, the first reception section 111, the second reception section 112, and the third reception section 113 may respectively receive the first information, the second information, and the third information described above for each of the multiple periods and may write the first information, the second information, and the third information in the correction-value table 121. The first command section 115 may correct the image so that the total area of the noise of multiple lines occurring with these multiple periods in the transport direction of the sheet P is reduced.

In addition to the above-described correction, the image forming apparatus 1 may perform correction using a waveform that is symmetrical in the increasing-decreasing direction, such as a sine wave. Furthermore, based on the first information, the second information, and the third information described above, the image forming apparatus 1 may perform multiple ways of correction by using the distance X1 from the reference point, the density level X2, and the width X3 indicated by these pieces of information and a combination of numerical values obtained by adding or subtracting a constant to or from these set values. In this case, the image forming apparatus 1 may set the correction set values by allowing the user to select an image formed in each of the multiple ways of correction.

2.7. Seventh Modification

In the above-described exemplary embodiment, the developing section 13 is configured to form a monochrome image onto the image bearing member 31 by using the developing unit 34 that supplies a monochrome toner. Alternatively, the developing section 13 may be configured to use multiple developing units to form a color image onto a sheet P by using toners of multiple colors. In this case, the developing section 13 may be of a tandem type in which multiple image bearing members 31 are arranged in the moving direction of, for example, a transfer belt. In the case where the developing section 13 is configured to form an image by using toners of multiple colors, a development condition may be set for each of these colors.

Furthermore, in the above-described exemplary embodiment, the transfer section 14 transfers an image onto a sheet P, which is a medium, directly from the image bearing member 31 of the developing section 13 based on a direct transfer method. Alternatively, the transfer section 14 may be configured to perform the transfer process based on an indirect transfer method. In this case, the transfer section 14 may have an intermediate transfer member, such as a transfer belt, which transfers an image formed on the image bearing member 31, and may transfer the transferred image onto a medium, such as a sheet P, from this intermediate transfer member.

2.8. Eighth Modification

In the above-described exemplary embodiment, the user operates the touchscreen of the operable section 17 disposed over the display section 18. Alternatively, for example, the operator may input correction set values by operating a combination of switch devices, which are elements of an electronic circuit, such as multiple pin switches or slide switches included in the operable section 17. In this case, the operable screen does not have to be displayed on the display section 18, or the display section 18 does not have to be provided.

2.9. Ninth Modification

The program to be executed by the controller 11 of the image forming apparatus 1 may be provided in a stored state in a computer readable storage medium, which may be, for example, a magnetic storage medium, such as a magnetic tape or a magnetic disk; an optical storage medium, such as an optical disk; a magneto-optical storage medium; or a semiconductor memory. Furthermore, this program may be downloaded via a communication line, such as the Internet. As a controller described above as the controller 11, various types of devices other than the CPU may be used. For example, a dedicated processor may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control device comprising:

a first reception section that receives first information from a user when an image forming unit forms a first image onto a medium based on image data and outputs the first image to the user, the first information indicating a position of noise occurring with predetermined periodicity in a transport direction of the medium;

a second reception section that receives, from the user, second information corresponding to a density of the noise;

a third reception section that receives, from the user, third information indicating a width of the noise in the transport direction; and a first command section that commands the image forming unit to form a second image obtained by correcting the first image onto the medium based on the first information, the second information, and the third information.

2. The control device according to claim 1, wherein the image forming unit includes a developing unit that rotates in a direction according to the transport direction, and wherein the first command section commands the image forming unit to form the second image corrected in accordance with a phase of the developing unit onto the medium.

3. The control device according to claim 1, wherein the first command section commands the image forming unit to form the second image, which is obtained by correcting the first image to reduce the noise, onto the medium.

4. The control device according to claim 1, wherein the image forming unit includes an image bearing member onto which a latent image according to the first image is formed, an exposure unit that performs exposure by radiating light onto a surface of the image bearing member in accordance with the image data, and a developing unit that supplies a developer to the surface of the image bearing member exposed to the light, and wherein the first command section commands the image forming unit to form the second image onto the medium by causing the exposure unit to adjust an intensity of the radiation light.

5. The control device according to claim 1, further comprising:

a fourth reception section that receives a command for selecting a shape from a plurality of shapes, wherein the first command section commands the image forming unit to form the second image, which is corrected in accordance with the shape indicated by the command received by the fourth reception section, onto the medium.

6. The control device according to claim 1, wherein the image data includes halftone image data having uniform density and image data indicating a position in the transport direction of the medium, wherein the control device further comprises a display controller that causes a display to display an operable screen for allowing the first reception section, the second reception section, and the third reception section to respectively receive the first information, the second information, and the third information after an image based on the image data is formed on the medium, and wherein the first command section commands the image forming unit to form the second image onto the medium after the operable screen is displayed by the display.

7. The control device according to claim 1, wherein the first reception section receives the first information indicating the position of the noise occurring with each of a plurality of periods set in the transport direction for each of the periods, wherein the second reception section receives the second information for each of the periods, wherein the third reception section receives the third information for each of the periods, and wherein the first command section commands the image forming unit to form the second image onto the medium, the second image being obtained by correcting the first image so that a total area of the noise occurring with the plurality of periods is reduced.

8. An image forming apparatus comprising:

an image forming unit that forms an image onto a medium; and a control device that controls the image forming unit, wherein the control device includes a first reception section that receives first information from a user when the image forming unit forms a first image onto the medium based on image data and outputs the first image to the user, the first information indicating a position of noise occurring with predetermined periodicity in a transport direction of the medium, a second reception section that receives, from the user, second information corresponding to a density of the noise, a third reception section that receives, from the user, third information indicating a width of the noise in the transport direction, and a first command section that commands the image forming unit to form a second image obtained by correcting the first image onto the medium based on the first information, the second information, and the third information.

9. A non-transitory computer readable medium storing a program causing a computer to execute a control process, the control process comprising:

receiving first information from a user when an image forming unit forms a first image onto a medium based on image data and outputs the first image to the user, the first information indicating a position of noise occurring with predetermined periodicity in a transport direction of the medium;

receiving, from the user, second information corresponding to a density of the noise;

receiving, from the user, third information indicating a width of the noise in the transport direction; and commanding the image forming unit to form a second image obtained by correcting the first image onto the medium based on the first information, the second information, and the third information.

10. A control method comprising:

receiving first information from a user when an image forming unit forms a first image onto a medium based on image data and outputs the first image to the user, the first information indicating a position of noise occurring with predetermined periodicity in a transport direction of the medium;

receiving, from the user, second information corresponding to a density of the noise;

receiving, from the user, third information indicating a width of the noise in the transport direction; and commanding the image forming unit to form a second image obtained by correcting the first image onto the medium based on the first information, the second information, and the third information.

* * * * *